US008220682B2

(12) United States Patent
Johnson

(10) Patent No.: US 8,220,682 B2
(45) Date of Patent: Jul. 17, 2012

(54) HUNTING CALL HOLDER

(76) Inventor: David Lawrence Johnson, Ashland City, TN (US)

( * ) Notice: Subject to any disclaimer, the term of this patent is extended or adjusted under 35 U.S.C. 154(b) by 185 days.

(21) Appl. No.: 12/704,837

(22) Filed: Feb. 12, 2010

(65) Prior Publication Data

US 2010/0206918 A1 Aug. 19, 2010

Related U.S. Application Data

(60) Provisional application No. 61/153,664, filed on Feb. 19, 2009.

(51) Int. Cl.
*A45F 4/00* (2006.01)
*B65D 85/00* (2006.01)

(52) U.S. Cl. ..... 224/584; 206/315.11

(58) Field of Classification Search ..... 206/315.1, 206/315.11; 224/579, 667, 677, 153, 580, 224/584; 383/33, 104; 135/120.1, 121–138, 135/161, 901; 43/1
See application file for complete search history.

(56) References Cited

U.S. PATENT DOCUMENTS

| | | | | | |
|---|---|---|---|---|---|
| 2,783,766 | A * | 3/1957 | Kohlbeck | 135/901 |
| 3,361,312 | A * | 1/1968 | Hutchison | 224/677 |
| 4,632,138 | A * | 12/1986 | Irwin | 135/901 |
| 4,723,371 | A * | 2/1988 | Williams | 135/127 |
| 4,858,635 | A | 8/1989 | Eppenbach | |
| 5,263,838 | A * | 11/1993 | Meuser et al. | 206/315.11 |
| 5,407,111 | A * | 4/1995 | Lanouette et al. | 224/579 |
| 5,628,338 | A * | 5/1997 | Stumbo | 135/901 |
| 5,671,766 | A | 9/1997 | Williams | |
| 5,918,615 | A * | 7/1999 | Stuck, Sr. | 135/117 |
| 5,947,353 | A * | 9/1999 | Johnson | 224/678 |
| 6,202,665 | B1 * | 3/2001 | O'Hare | 135/901 |
| 7,040,333 | B1 | 5/2006 | Ransom et al. | |
| 7,051,908 | B2 * | 5/2006 | Mignano | 224/153 |
| 7,308,994 | B1 * | 12/2007 | Vanicek | 206/315.11 |
| 7,475,699 | B2 | 1/2009 | Johnson et al. | |
| 2003/0213825 | A1 * | 11/2003 | Hale | 224/421 |

* cited by examiner

*Primary Examiner* — Bryon Gehman
(74) *Attorney, Agent, or Firm* — James Addison Barry, Jr.

(57) ABSTRACT

The hunting call holder 100 comprises a pocket apron 110 comprising heavy cloth sewn together in layers 161, 163, and 165 with different levels 162, 164, and 166; with a sleeve 120 wherein a support rod 800 is placed in the sleeve 120 to prevent the collapse of the hunting call holder 100 when the hunting call holder 100 is loaded with calls and gear; and strap closers 140 are attached at opposing ends of the hunting call holder 100 for attaching the hunting call holder 100 with a structure 900 of a pop-up blind.

5 Claims, 3 Drawing Sheets

HUNTING CALL HOLDER

CROSS-REFERENCE

This application claims the benefit of U.S. Provisional Application Ser. No. 61/153,664, filed Feb. 19, 2009, titled Hunting Call Holder. The present application is related by the same inventor for all applications; David Lawrence Johnson. The U.S. Provisional Application Ser. No. 61/153,664, filed Feb. 19, 2009, titled Hunting Call Holder is hereby incorporated in its entirety by reference.

FIELD OF INVENTION

The present invention generally relates to the field of pocket holders for hunting. More specifically this relates to a hunting pocket holder for holding hunting and personal equipment for use with a pop-up blind.

BACKGROUND OF INVENTION

A hunting blind is used to conceal the hunter from game and to provide some protection from the elements. Portable enclosures, such as tents, have been used as blinds and shelters for many years. Hunting blinds come in various different styles and configurations and may be in the form of a tent-like structure. Portable, lightweight, durable and affordable enclosures such as pop-up blinds are increasing in popularity. However, one of the drawbacks of these shelters is pocket space for holding equipment and personal items. There is a need for a hunting pocket holder that will hold hunting and personal equipment as well as turkey and other animal calls such that the pocket apron holder may easily attach with the structure of the pop-up blind.

SUMMARY

One embodiment of a hunting call holder for holding animal calls and hunting equipment attachable with diagonal support members of a pop-up hunting blind, the hunting call holder comprises a pocket apron wherein the width and the height portion of the hunting call holder are such that the diagonal support members assist in the support and attachment of the hunting call holder; a sleeve such that a support rod may be used to prevent the collapse of the hunting call holder when the hunting call holder is loaded with calls and hunting equipment; at least two straps for attaching the hunting call holder to the pop-up hunting blind diagonal support members; and a plurality of pockets formed in the pocket apron such that a variety of animal calls and hunting equipment and gear fit in the pockets.

Another embodiment of the hunting call holder further comprises the pocket apron wherein the plurality of pockets includes three layers that are at three levels wherein the pockets are in the center and on the left and right side of the center wherein two back-layer/upper-level left and right pockets; two back- layer/upper-level center pockets; two mid-layer/center-level side pockets wherein the mid-layer/center-level side pockets include pleats to hold larger type calls and gear; a mid-layer/center-level center pocket; and a front-layer/lower-level center pocket. Another embodiment may further include a combination of the support rod, and two additional straps for attaching the hunting call holder with the diagonal support members when additional extension is required.

Yet another embodiment of the hunting call holder further comprises two additional straps for attaching the hunting call holder with the diagonal support members when additional extension is required.

BRIEF DESCRIPTION OF THE DRAWINGS

The features, aspects, and advantages of the invention will become better understood with regard to the following description, appended claims, and accompanying drawings where:

DETAILED DESCRIPTION OF THE INVENTION

The present invention relates to the field of pocket holders for hunting. More specifically this invention relates to a hunting pocket holder for holding equipment including but not limited to animal calls for use with a pop-up blind. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

Overview

Figure 1:
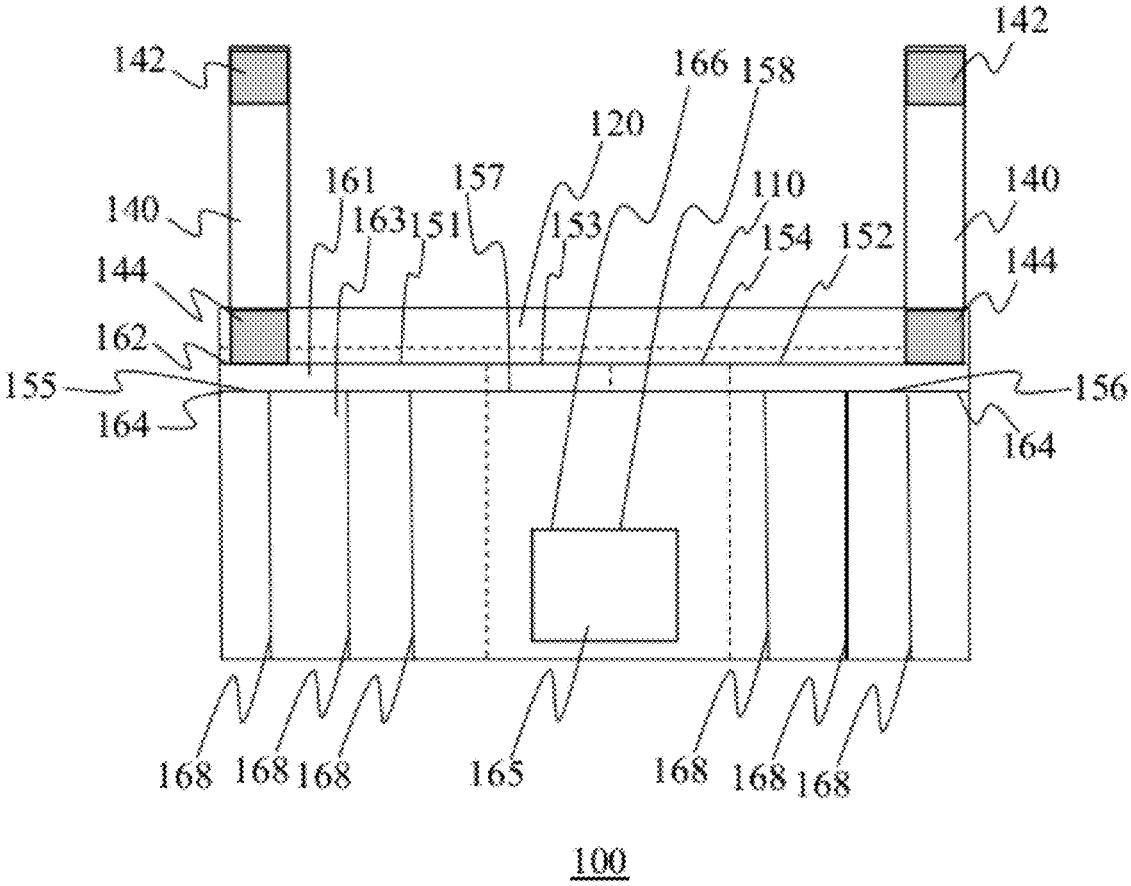
FIG. 1 is a front view of one embodiment hunting call holder.
Figure 2:
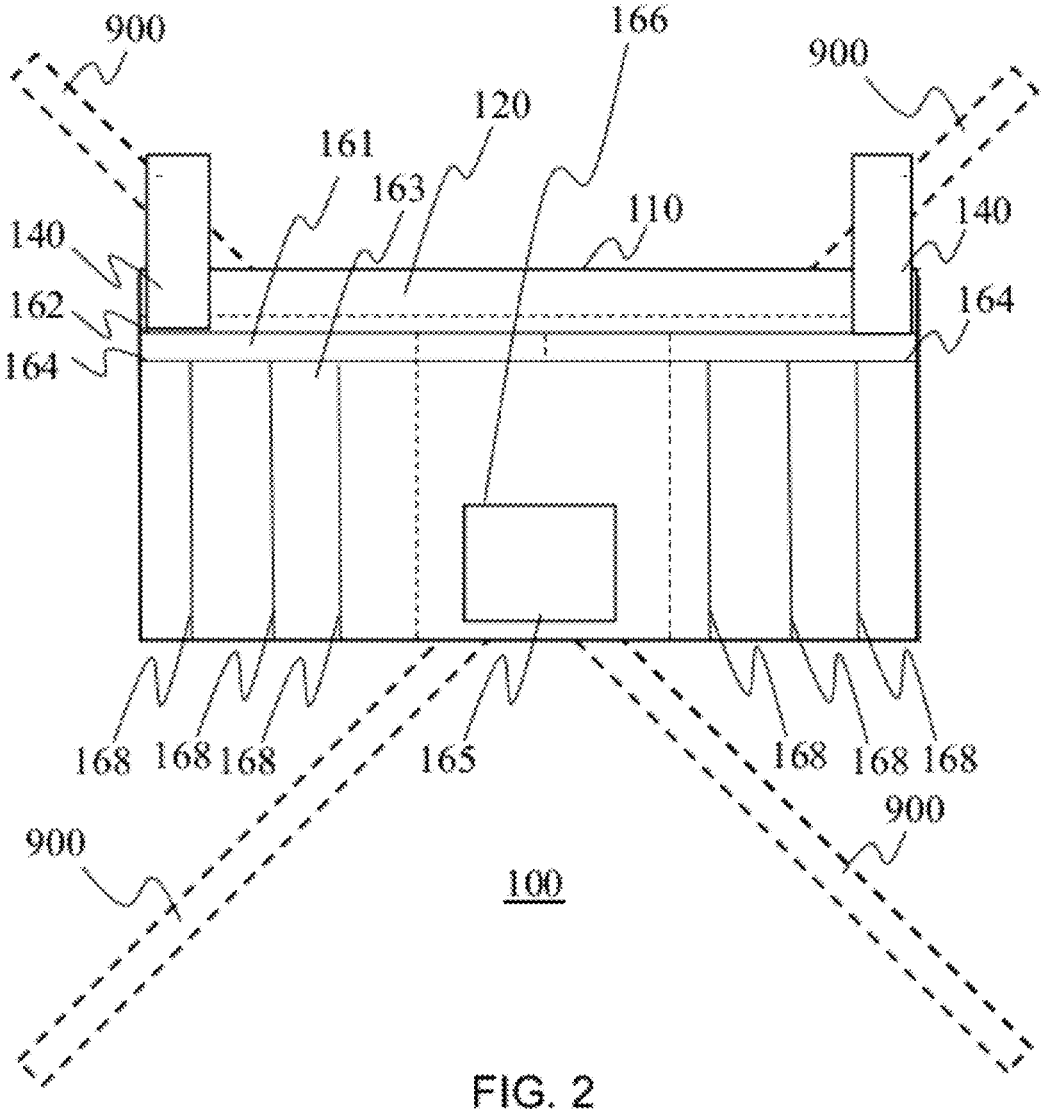
FIG. 2 is a front view depicting one embodiment of the hunting call holder attached with a pop-up hunting blind.
Figure 3:
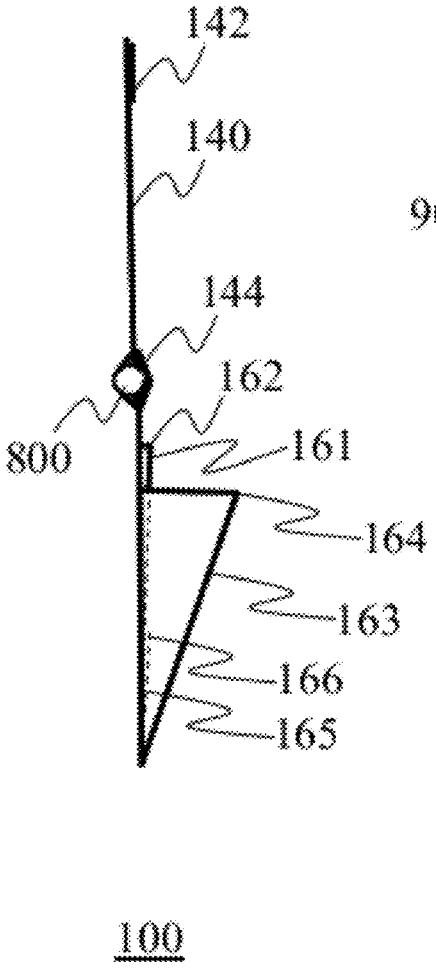
FIG. 3 is a side view of one embodiment of the hunting call holder.
Figure 4:
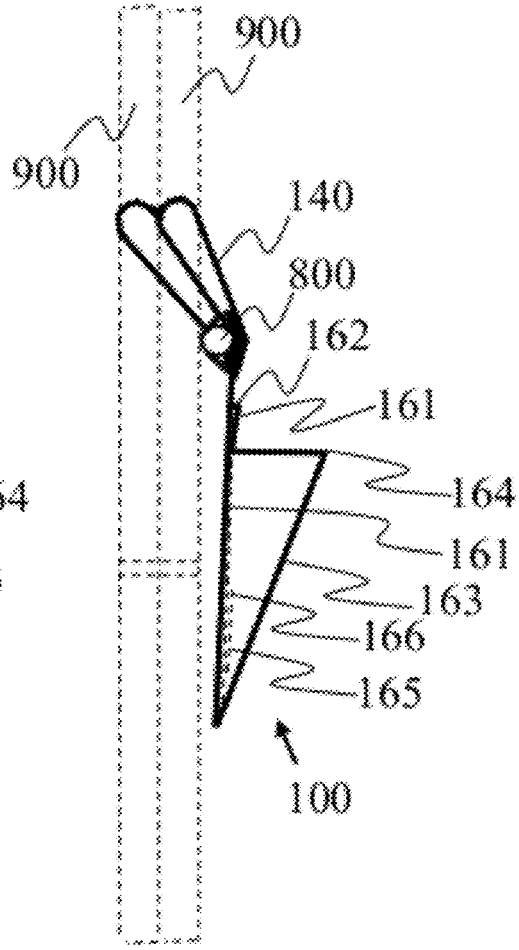
FIG. 4 is a side view depicting one embodiment of the hunting call holder attached with a pop-up hunting blind.
Figure 5:
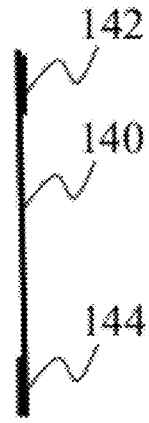
FIG. 5 is a side view of one embodiment of an additional elongated strap for extension.

Referring to FIGS. 1 through 4, one embodiment of a hunting call holder 100 for holding hunting and personal items as well as animal hunting calls is depicted. The hunting call holder 100 comprises a pocket apron 110 comprising heavy cloth sewn together in layers with different levels; with a sleeve 120 wherein a support rod 800 is placed in the sleeve 120 to prevent the collapse of the hunting call holder 100 when the hunting call holder 100 is loaded with calls and gear; and strap closers 140 are attached at opposing ends of the hunting call holder 100 for attaching the hunting call holder 100 with the structure 900 of the pop-up blind.

Embodiments of a Hunting Call Holder

As illustrated in FIGS. 1 through 4, the hunting call holder 100 is constructed of heavy cloth sewn together in layers 161, 163, and 165 at different levels 162, 164, and 166 as a pocket apron 110. The dimensions may be adjusted proportionately such that the hunting call holder 100 is supported by the diagonal support members 900. The dimension for one embodiment of the hunting call holder 100 may be 15 inches in width, 5 inches deep and 7 inches in height. The color and pattern for the pocket apron 110 may be of a color that would not draw attention or concern from the animals. The color and pattern may include but is not limited to black and camouflage.

The hunting call holder includes multiple pockets 151, 152, 153, 154, 155, 156, 157, and 158 for animal calls and hunting/personal gear/equipment with multi-levels 162, 164, and 166 and multi-layers 161, 163, and 165. The pockets are constructed in the different levels 162, 164, and 166 and layers 161, 163, and 165 both in the center of the pocket apron 110 and to the sides, left and right of the center pockets.

One embodiment of the hunting call holder 100 may have eight pockets within 3 layers and 3 levels. This may include:

2 pockets for box calls, on the back layer/upper level/sides, 5½ inches by 5½ inches 151, 152;

2 pockets for strikers, back layer/upper level/center, 2 inches by 5½ inches 153, 154;

2 pockets for slate and scratch box calls, mid layer/center level/sides, 6 inches by 4½ inches 155, 156;

1 pocket for slate call, mid layer/center level, center, 4 inches by 5 inches 157; and 1 pocket for mouth/reed calls, front layer/lower level/centered, 3½ inches by 2¾ inches 158.

The sleeve 120 on the top of the hunting call holder 100 may hold a support rod 800 15 inches long and ¼ inches in diameter. The sleeve 120 will prevent the collapse of the hunting call holder 100 when the hunting call holder 100 is loaded with calls and hunting gear. The support rod 800 may be removable. The hunting call holder 100 is attachable with diagonal support members 900 of a pop-up blind with elongated attachment straps 140 that may wrap around attachment points on the diagonal support members 900. One method of attachment includes 5 inch elongated straps 140 with a fastening tape including hook and loop fasteners 142, 144 sometimes referred to as Velcro. A piece with hooks 142 is attached with one end of the strap 140 and a piece with loops 144 is attached with the other end or one a portion of the pocket apron 110. In situations where longer straps are required, two additional 5 inch elongated straps 141 with hook and loop fasteners 142, 144 may be connected with the original two hook and loop fasteners 142, 144 with elongated straps 140 to allow extension.

A kit for the hunting call holder 100 may include the support rod 800, extensions 141, and hunting call holder 100.

What is claimed is:

1. A hunting call holder attachable with diagonal support members of a pop-up hunting blind, the hunting call holder comprising:

a pocket apron including a plurality of pockets; a sleeve; a support rod, and at least two straps wherein;

the structure of the pocket apron comprises a heavy cloth pocket apron and multiple layers of heavy cloth forming the plurality of pockets wherein each layer of heavy cloth and the heavy cloth pocket apron include a top side, a front, a left side, and a right side wherein the pocket apron and the multiple layers further comprise:

a first layer of heavy cloth attached with the front of the heavy cloth pocket apron, a second layer of heavy cloth attached with the front of the first layer of heavy cloth, and a third layer of heavy cloth attached with the front of the second layer of heavy cloth, wherein the multiple layers of heavy cloth comprise multiple levels, the multiple levels further comprising a first level disposed with the front of the pocket apron below the sleeve, a second level disposed with the front of the first layer below the first level, and a third level disposed with the front of the second layer below the second level; wherein the plurality of pockets are formed in the pocket apron such that a variety of animal calls and hunting equipment and fit in the pockets;

the sleeve having a tight diameter large enough for the support rod to be inserted and removed within the sleeve and the sleeve inside diameter being narrow enough for the sleeve and the support rod combination to provide support from collapsing with the weight of the equipment in the pocket apron, the sleeve includes attachment along the top side of the pocket apron between the opposing right and left sides of the pocket apron of the hunting call holder further preventing collapse of the hunting call holder wherein the sleeve including the support rod is disposed against the diagonal support members of the pop-up hunting blind; and the at least two straps attached with the top side of the pocket apron disposed on the right and left sides of the pocket apron for attaching the hunting call holder to the pop-up hunting blind diagonal support members.

2. The hunting call holder as set forth in claim 1 wherein the hunting call holder further comprises two additional straps for attaching the hunting call holder with the diagonal support members such that additional strap extension is available.

3. The hunting call holder as set forth in claim 1 wherein the pocket apron includes:

the first layer of heavy cloth and first level of heavy cloth form rear layer, upper level pockets disposed on the right side and the left side of the center of the pocket apron;

the second layer of heavy cloth and second level of heavy cloth form a middle of the multiple layers, second level pockets wherein a center pocket is disposed over the center of the pocket apron, a right pocket is disposed between the center pocket and the right side of the pocket apron, and a left pocket is disposed between the center pocket and the left side of the pocket apron further comprising pleats to expand to hold larger calls and equipment; and the third layer of heavy cloth and third level of heavy cloth form a front layer, lower level center pocket, wherein the center front layer, lower level pocket is disposed over the center of the pocket apron.

4. The hunting call holder as set forth in claim 3 in combination with the support rod and two additional straps for attaching the hunting call holder with the diagonal support members when additional extension is required.

5. The hunting call holder as set forth in claim 1 wherein the sleeve is a continuous sleeve extending from the left side of the pocket apron to the right side of the pocket apron such that the support rod and the sleeve combination further provide rigid support in combination with the straps on the left side and the right side of the sleeve for attaching with the diagonal support members and for disposing the sleeve with the support rod with the diagonal support members such that the support rod within the continuous sleeve provides further support.

* * * * *